US008643261B2

(12) United States Patent
Below

(10) Patent No.: US 8,643,261 B2
(45) Date of Patent: Feb. 4, 2014

(54) SPARK PLUG WITH UNDERCUT INSULATOR AND ONE PIECE SHELL

(75) Inventor: Matthew Brian Below, Fundlay, OH (US)

(73) Assignee: Fram Group IP LLC, Lake Forest, IL (US)

( * ) Notice: Subject to any disclaimer, the term of this patent is extended or adjusted under 35 U.S.C. 154(b) by 110 days.

(21) Appl. No.: 13/283,721

(22) Filed: Oct. 28, 2011

(65) Prior Publication Data

US 2012/0112621 A1 May 10, 2012

Related U.S. Application Data

(60) Provisional application No. 61/407,726, filed on Oct. 28, 2010.

(51) Int. Cl.
*H01T 13/20* (2006.01)

(52) U.S. Cl.
USPC ..... 313/141; 445/7

(58) Field of Classification Search
USPC ..... 313/118–145; 445/7
See application file for complete search history.

(56) References Cited

U.S. PATENT DOCUMENTS

| | | | | |
|---|---|---|---|---|
| 3,569,765 | A * | 3/1971 | Moray | 313/136 |
| 5,091,672 | A | 2/1992 | Below | |
| 5,697,334 | A | 12/1997 | Below | |
| 5,918,571 | A | 7/1999 | Below | |
| 6,104,130 | A | 8/2000 | Below | |
| 2008/0272683 | A1 | 11/2008 | Boehler et al. | |
| 2009/0079319 | A1 | 3/2009 | Boehler et al. | |
| 2009/0121603 | A1 | 5/2009 | Below et al. | |
| 2009/0189503 | A1 | 7/2009 | Below | |
| 2009/0189505 | A1 | 7/2009 | Below | |
| 2009/0189506 | A1 | 7/2009 | Below | |
| 2012/0104927 | A1 | 5/2012 | Below | |

* cited by examiner

*Primary Examiner* — Anne Hines
(74) *Attorney, Agent, or Firm* — Erin J. Fox; Barnes & Thornburg LLP

(57) ABSTRACT

A spark plug for an internal combustion engine, the spark plug having: an elongated center electrode having a center electrode tip at one end and a terminal proximate the other end; an insulator substantially surrounding the center electrode, the insulator having a channel formed in an exterior surface of the insulator; an outer shell surrounding the insulator having: a jamb nut portion with a distal end extending thereform, the distal end being aligned with the channel such that the distal end of the outer shell is received within and engages the channel; a motor seat portion proximate to the jamb nut portion; and a threaded portion proximate to the motor seat portion, wherein the jamb nut portion, the motor seat portion, and the threaded portion are all integrally formed with the outer shell as a single component.

15 Claims, 2 Drawing Sheets

SPARK PLUG WITH UNDERCUT INSULATOR AND ONE PIECE SHELL

CROSS REFERENCE TO RELATED APPLICATIONS

This application claims the benefit of U.S. Provisional Patent Application Ser. No. 61/407,726 filed Oct. 28, 2010, the contents of which are incorporated herein by reference thereto.

BACKGROUND

This application relates generally to spark plugs for internal combustion engines and, more particularly, to a jamb nut to insulator interface that to reduce loads on the spark plug insulator.

Traditional spark plug construction includes an annular metal casing having threads near one end and a ceramic insulator extending from the threaded end through the metal casing and beyond the opposite end. A central electrode is exposed near the threaded end and is electrically connected through the insulator interior to a terminal which extends from the opposite insulator end to which a spark plug ignition wire attaches.

The force applied to seal the spark plug in the head is the result of torque transmitted by the threaded metal casing; hence, the threaded portion of the metal casing must be sturdy and of substantial size. A portion of the metal casing is formed to be engaged by a socket tool to provide torque to the threaded portion. The threaded portion is located away from the portion which is engaged by the socket tool.

To facilitate the controlled and efficient exhaust of gases from a combustion chamber, the valves are sometimes increased in size. This may necessitate a decrease in the size of the spark plug, a reduction in the size and sturdiness of the threaded metal casing end, and, in particular, a decrease in the inside diameter of the metal bore of the spark plug and in the combustion chamber wall area available to threadingly receive the spark plug.

The maximum diameter of the ceramic insulator is in turn determined by the size of the hex or jamb nut portion of the outer shell. Accordingly and for smaller hexes the barrel diameter of the ceramic insulator is reduced. The diameter ceramic insulator is also dictated by the clearance needed for shell hex and crimp along with the shoulder needed to keep the ceramic in place during a lifetime of operation.

In the past and for 14 mm and 16 mm spark plug hexes (12 mm spark plugs), the diameter of the ceramic insulator is different for each application and requires different ignition boots. For example, the 14 mm hex uses a 9.0 mm diameter ceramic barrel and the 16 mm hex uses a 10.5 mm diameter ceramic barrel.

Accordingly, it would be desirable to provide a 14 mm hex spark plug that can use the larger diameter insulator of the 16 mm hex spark plug.

The decrease in the diameter of the spark plug may reduce the spark plugs ability to hold onto its ground shield during removal. A higher strength steel jamb nut has been proposed to combat this problem however, a higher strength steel jamb nut is assembled to the insulator with higher loads than a lower strength steel jamb nut thus, the impact strength of the insulator may be negatively affected.

Accordingly, the inventor herein has recognized that it is desirable to provide a jamb nut to insulator interface that reduces loads upon the insulator. In addition, the inventor has recognized that it is also desirable to use smaller spark plug hex designs with ceramic insulator barrels and ignition wires typically associated with larger spark plug hex designs.

SUMMARY

Exemplary embodiments of the present invention relate to a spark plug for an internal combustion engine. The spark plug having: an elongated center electrode having a center electrode tip at one end and a terminal proximate the other end; an insulator substantially surrounding the center electrode, the insulator having a channel formed in an exterior surface of the insulator; an outer shell surrounding the insulator having: a jamb nut portion with a distal end extending thereform, the distal end being aligned with the channel such that the distal end of the outer shell is received within and engages the channel; a motor seat portion proximate to the jamb nut portion; and a threaded portion proximate to the motor seat portion, wherein the jamb nut portion, the motor seat portion, and the threaded portion are all integrally formed with the outer shell such that the outer shell comprises the jamb nut portion, the motor seat portion, and the threaded portion, which are formed as a single component.

Exemplary embodiments of the present invention also relate to a method of forming a spark plug. The method comprising the steps of inserting an insulator into an outer shell of the spark plug, the insulator having a first portion, a second portion and a third portion, the first portion being located at one end of the insulator and the third portion being located at an opposite end of the insulator, wherein a channel is located in the third portion and the second portion has a larger thickness than the first portion and the third portion; contacting the channel with a portion of the outer shell proximate to a distal end of the outer shell, the distal end extending from a jamb nut portion of the outer shell; and wherein the outer shell has a motor seat portion and a threaded portion integrally formed with the jamb nut portion and the motor seat portion is located between the jamb nut portion and the threaded portion.

DESCRIPTION OF EXEMPLARY EMBODIMENTS

Figure 1:
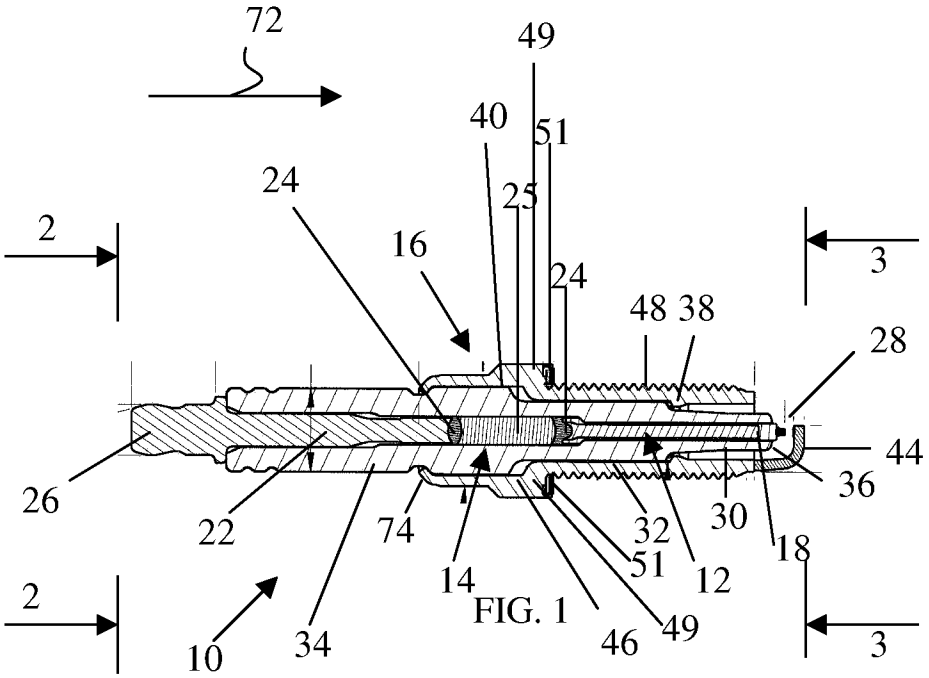
FIG. 1 is a cross-sectional view of a spark plug in accordance with an exemplary embodiment of the present invention.
Figure 2:
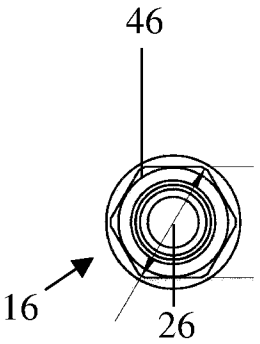
FIG. 2 is a view along lines 2-2 of FIG. 1.
Figure 3:
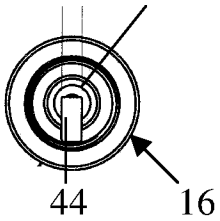
FIG. 3 is a view along lines 3-3 of FIG. 1.

Non-limiting examples of spark plug and ground shield/strap configurations are found in the following U.S. Pat. Nos. 5,091,672; 5,697,334; 5,918,571; and 6,104,130 and U.S. Patent Publications US 2008/0272683; US 2009/0079319; US 2009/0121603; US 2009/0189503; US 2009/0189505; and US 2009/0189506 the contents each of which are incorporated herein by reference thereto.

Some high thread designs have a potential of leaving the ground shield stuck in the engine head as there is a potential of breaking behind the hex on the insulator shoulder when dropped. Exemplary embodiments disclosed herein should improve the insulator strength and ground shield retention during removal of the spark plug from the engine. To improve the ground shield retention the jamb nut has been modified to have a solid lower seat instead of a crimp surface. This will move the crimp to the top side of the hex as illustrated in the attached drawings. The relocation of the crimp will also improve the impact strength of the spark plug. The impact strength of the spark plug is measured with the plug installed. By relocating the crimp the same is not compressed or constrained and will absorb more energy when the plug is dropped. Also illustrated is that the jam nut has a solid ring incorporated under the ground shield seat. The ring will keep the seat from splitting and loosening its hold on the ground shield.

FIGS. 1-4 illustrate an overall structure of an exemplary embodiment of the present invention. A spark plug 10 is illustrated and designed for use in internal combustion engines. The installation of spark plug 10 into an internal combustion engine is achieved by fitting it so that it protrudes into a combustion chamber (not shown) of the engine through a threaded bore provided in the engine head (not shown). Spark plug 10 includes a cylindrical center electrode 12 extending along the axial length of the spark plug, a ceramic or similarly comprised insulator 14 that concentrically surrounds center electrode 12, and an outer shell 16 that concentrically surrounds insulator 14.

In the illustrated embodiment, center electrode 12 has a cylindrical body with a tip 18 at one end and an end 20 of center electrode 12 opposing tip 18 is electrically connected to a cylindrical terminal stud 22 through an electrically conductive glass seal 24 disposed at either ends of an internal resistive element 25. In an alternative embodiment, the spark plug is formed without resistor 25 and thus only one glass seal is required. In one embodiment, the electrically conductive glass seal can be a fired-in seal. The glass seal serves as the electrical connection between terminal stud and the center electrode. The terminal stud further comprises a terminal nut 26 that protrudes from the insulator and is configured to attach to an ignition cable (not shown) that supplies the electric current to the plug when the plug is installed.

The center electrode may comprise a core made of a highly heat conductive metal material such as, for example, copper, covered by a longer than conventional sheath made a highly heat-resistant, corrosion-resistant metal material such as, for example, Inconel, another nickel-based alloy, or other suitable metal or metal alloy. Still further, the center electrode will have a noble metal chip 28, such as one made from a gold, palladium, or platinum alloy in any suitable form for enabling proper spark plug functioning such as, for example, flat or finewire, that is joined to center electrode tip 18 to improve heat transfer and maintain the sparking gap. As is known in the related arts, the terminal stud can comprise steel or a steel-based alloy material with a nickel-plated finish.

As illustrated, the insulator has an elongated, substantially cylindrical body with a first 30, a second 32, and a third 34 insulator sections each having different diameters. The first insulator section substantially surrounds the center electrode and terminates at a distal end 36. The second insulator section is located intermediate first and third insulator sections and the diameter of the third insulator section is greater than that of either of the other two insulator sections. The second insulator section and the narrower first insulator section are separated from each other by a shoulder portion 38 while the second insulator section and the third insulator section are separated from each other by a shoulder portion 40.

The spark plug further comprises an outer shell 16 and a ground strap 44 extending therefrom. The outer shell further comprises an integral jamb nut portion 46, an integral threaded portion 48 and a motor seat portion 49 disposed therebetween.

To improve the ground shield retention the jamb nut has been modified to have a solid lower seat 49 instead of a crimp surface. This will move the crimp to the top side of the hex as illustrated in the attached drawings. Also illustrated, is that the jam nut has a solid ring 51 incorporated under the ground shield seat 49. The ring will keep the seat from splitting and loosening its hold on the ground shield.

The plurality of threads are configured to threadingly engage a threaded portion of a generally cylindrical opening that is in communication with the combustion chamber of an internal combustion engine. The threaded portion of the outer shell is also configured to surround the first and second sections of the insulator. The jam nut portion is integrally formed with the outer shell such that the spark plug can be removed in a helical pattern as the jam nut is unscrewed, resulting in easy, direct removal with negligible tipping. A suitable socket tool can engage the jam nut of the outer shell for screwing the spark plug into and out of the engine bore.

The motor seat portion is located at the bottom of the jamb nut portion and is adjacent to the threaded portion.

Figure 4:
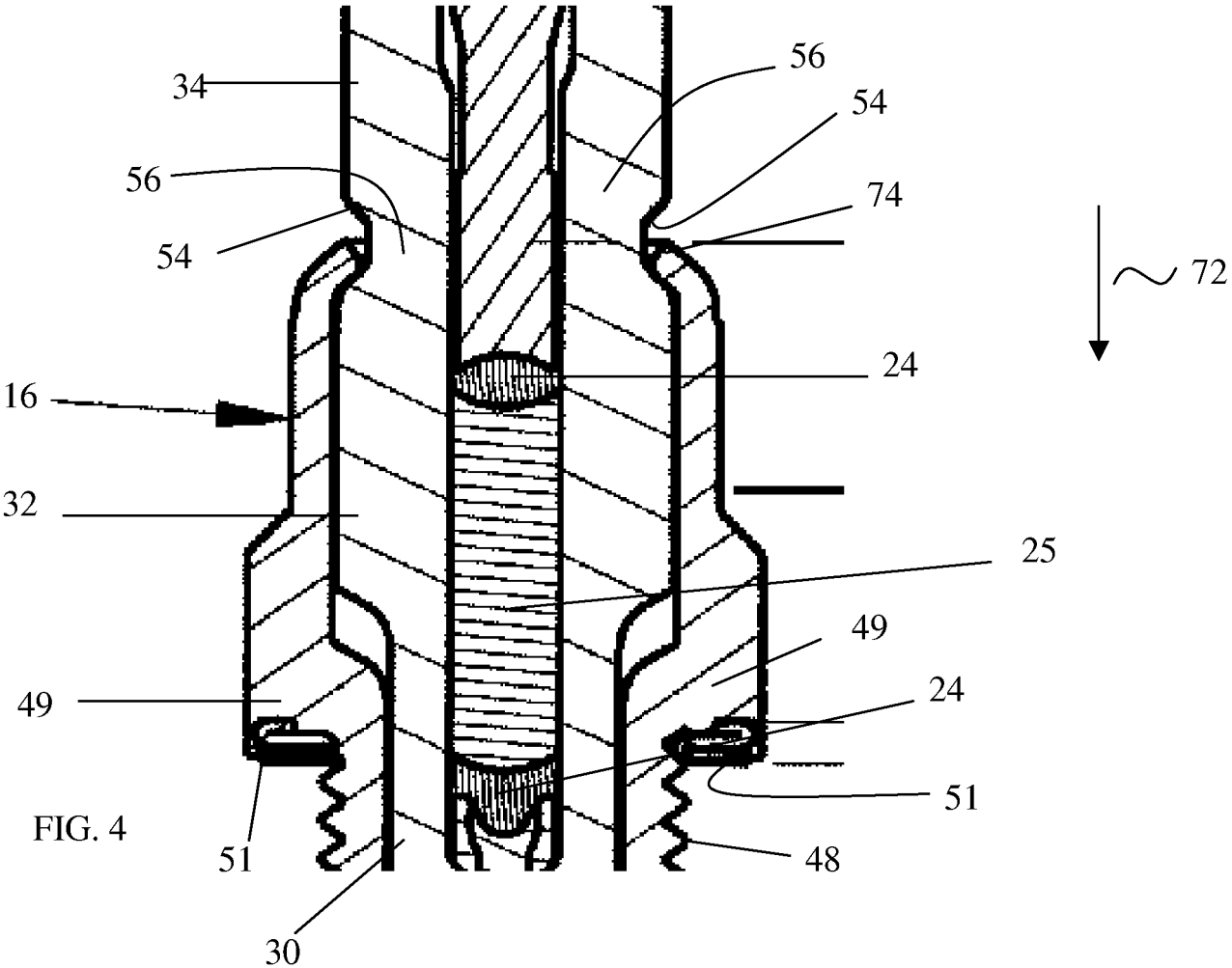
FIG. 4 is an enlarged view of a portion of FIG. 1.

Referring now in particular to FIGS. 1 and 4, the insulator further comprises a channel 54 formed in the exterior surface of the insulator, the channel provides a section 56 of the insulator located between two portions of the third portion of the insulator. As illustrated, section 56 has a reduced thickness such that is smaller than adjacent portions of the third section.

During assembly, the insulator is inserted axially into the outer shell in the direction of arrow 72 then a distal end 74 of the outer shell is pressed into channel 54 such that the insulator is captured within the assembly of the outer shell and the ground shield.

The outer shell will comprise a conductive metal material such as a nickel-plated, low-carbon steel-based alloy and the threaded section can have an outer thread diameter of about 16 mm or less; for example, the threaded section can have an outer diameter of about 10 mm to allow for a greater amount of engine space.

The shape, size, and particular construction of outer shell as well as the insulator may, of course, vary greatly from one design to another; hence, the aforementioned dimensional attributes of the outer shell are merely provided as non-limiting examples.

Still further, noble metal chips can be joined to the center electrode tip and a ground electrode strap by any suitable joining technique such as brazing, laser welding, resistance welding, or plasma welding.

The insulator is formed from a non-conducting ceramic material such as, for example, alumina ceramic so that it may fixedly retain center electrode while preventing an electrical short between the center electrode and the ground shield.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof Therefore, it is intended that the invention not be limited to the particular embodiment disclosed as the best mode contemplated for carrying out this invention, but that the invention will include all embodiments falling within the scope of the appended claims and their legal equivalence.

What is claimed is:

1. A spark plug for an internal combustion engine, the spark plug comprising:

an elongated center electrode having a center electrode tip at one end and a terminal proximate the other end;

an insulator substantially surrounding the center electrode, the insulator having a channel formed in an exterior surface of the insulator;

an outer shell surrounding the insulator having: a jamb nut portion with a distal end extending thereform, the distal end being aligned with the channel such that the distal end of the outer shell is received within and engages the insulator within the channel;

a motor seat portion proximate to the jamb nut portion; and a threaded portion proximate to the motor seat portion, wherein the jamb nut portion, the motor seat portion, and the threaded portion are all integrally formed with the outer shell such that the outer shell comprises the jamb nut portion, the motor seat portion, and the threaded portion, which are formed as a single component.

2. The spark plug as in claim 1, wherein the insulator has a first portion, a second portion and a third portion, the first portion being located at one end of the insulator and the third portion being located at an opposite end of the insulator, wherein the channel is located in the third portion and the second portion has a larger thickness than the first portion and the third portion has a larger thickness than the first portion.

3. The spark plug as in claim 2, wherein the insulator further comprises a shoulder portion configured to engage a portion of the distal end of the outer shell as it is crimped into the channel.

4. The spark plug as in claim 1, wherein the insulator further comprises a shoulder portion configured to engage a portion of the distal end of the outer shell as it is crimped into the channel.

5. The spark plug as in claim 4, wherein the insulator further comprises another shoulder portion located in the first portion, the another shoulder portion being configured to engage a portion of the outer shell having the threaded portion.

6. The spark plug as in claim 1, wherein the insulator is made from a non-conducting ceramic material.

7. The spark plug as in claim 6, wherein the center electrode extends form one end of the insulator and the terminal extends from an opposite end of the insulator.

8. A method of forming a spark plug, comprising:

inserting an insulator into an outer shell of the spark plug, the insulator having a first portion, a second portion and a third portion, the first portion being located at one end of the insulator and the third portion being located at an opposite end of the insulator, wherein a channel is located in the third portion and the second portion has a larger thickness than the first portion and the third portion;

contacting the insulator within the channel with a portion of the outer shell proximate to a distal end of the outer shell, the distal end extending from a jamb nut portion of the outer shell; and wherein the outer shell has a motor seat portion and a threaded portion integrally formed with the jamb nut portion and the motor seat portion is located between the jamb nut portion and the threaded portion.

9. The method a in claim 8 wherein the insulator has a first portion, a second portion and a third portion, the first portion being located at one end of the insulator and the third portion being located at an opposite end of the insulator, wherein the channel is located in the third portion and the second portion has a larger thickness than the first portion and the third portion has a larger thickness than the first portion.

10. The method as in claim 9, wherein the insulator further comprises a shoulder portion configured to engage a portion of the distal end of the outer shell as it is crimped into the channel.

11. The method as in claim 8, wherein the insulator further comprises a shoulder portion configured to engage a portion of the distal end of the outer shell as it is crimped into the channel.

12. The method as in claim 11, wherein the insulator further comprises another shoulder portion located in the first portion, the another shoulder portion being configured to engage a portion of the outer shell having the threaded portion.

13. The method as in claim 8, wherein the insulator is made from a non-conducting ceramic material.

14. The method as in claim 13, wherein the center electrode extends form one end of the insulator and the terminal extends from an opposite end of the insulator.

15. A spark plug for an internal combustion engine, the spark plug comprising:

an elongated center electrode having a center electrode tip at one end and a terminal proximate the other end;

an insulator substantially surrounding the center electrode, the insulator having a channel formed in an exterior surface of the insulator, wherein the channel has a thickness that is less than thicknesses of portions of the insulator on opposing sides of the channel;

an outer shell surrounding the insulator having: a jamb nut portion with a distal end extending therefrom, the distal end being aligned with the channel such that the distal end of the outer shell is received within and engages the insulator within the channel;

a motor seat portion proximate to the jamb nut portion; and a threaded portion proximate to the motor seat portion, wherein the jamb nut portion, the motor seat portion, and the threaded portion are all integrally formed with the outer shell such that the outer shell comprises the jamb nut portion, the motor seat portion, and the threaded portion, which are formed as a single component.

* * * * *